United States Patent [19]

Hidaka et al.

[11] Patent Number: 5,044,608

[45] Date of Patent: Sep. 3, 1991

[54] OPERATING FORCE CONTROLLING DEVICE FOR OPERATING LEVER

[75] Inventors: Sachio Hidaka, Kakogawa; Yoshiaki Fujimoto, Himeji, both of Japan

[73] Assignee: Kabushiki Kaisha Kobe Seiko Sho, Kobe, Japan

[21] Appl. No.: 426,671

[22] Filed: Oct. 26, 1989

[30] Foreign Application Priority Data

Oct. 26, 1988 [JP] Japan ..... 63-271822
Oct. 26, 1988 [JP] Japan ..... 63-271823

[51] Int. Cl.[5] ..... B66D 1/44

[52] U.S. Cl. ..... 254/266; 254/361; 91/361

[58] Field of Search ..... 254/361, 266; 91/461, 91/463, 361

[56] References Cited

U.S. PATENT DOCUMENTS

| | | | |
|---|---|---|---|
| 2,591,871 | 4/1952 | Richolt | 91/369.1 |
| 2,947,285 | 8/1960 | Baltus | 91/361 |
| 3,568,572 | 3/1971 | Steinmetz | 91/361 |
| 3,685,290 | 8/1972 | Kruschke | 91/461 X |
| 3,739,813 | 6/1973 | Worden | 137/625.65 |
| 3,805,674 | 4/1974 | Sebesta | 91/461 |
| 3,995,831 | 12/1976 | Spanski et al. | 254/361 |
| 4,753,158 | 6/1988 | Hirata | 91/461 |

FOREIGN PATENT DOCUMENTS

| | | |
|---|---|---|
| 0247303 | 2/1987 | European Pat. Off. . |
| 0331177 | 6/1989 | European Pat. Off. . |
| 8806242 | 8/1988 | Int'l Pat. Institute . |

*Primary Examiner*—Katherine Matecki

*Attorney, Agent, or Firm*—Oblon, Spivak, McClelland, Maier & Neustadt

[57] ABSTRACT

An operating force controlling device includes a pair of reactive force mechanisms (70, 70') disposed in an opposing relationship to each other in the direction of operation of an operating lever (60). A load pressure of a motor (30) is detected by a detector (91, 91'), and a controlling signal is outputted from a controller (90) in response to the load pressure. A pilot pressure is outputted from an electromagnetic proportional pressure reducing valve (80) in response to the control signal. The pilot pressure is inputted into one of the chambers of the reactive force mechanisms (70, 70') which moves a rod (72, 72') to project, to apply an operation reactive force to the lever (60). The operation reactive force is controlled such that the rate of change thereof may be high when the load pressure of the motor (30) is low but may be low when the load pressure is high. A plurality of control patterns wherein the rate of change of the operation reactive force to the load pressure is different from each other are set to a controller. As an operator manually senses a change of the operation reactive force which is operating the lever (60), a change of the load pressure is sensed and initiation of movement of a suspended cargo is sensed.

19 Claims, 8 Drawing Sheets

60
61
62
62'
54
54'
Fa
Fb
72
72'
40
70
70'
71
71'
73
73'
51
51'
55
55'
43
42
52
52'
53
53'
50
50'
41
57
57'
56
56'
44
44'
81
81'
Pi
90
91
91'
92
93
Pa
Pb
31
32
30
34
20
21
21'
10
11
12
80
82

OPERATING FORCE CONTROLLING DEVICE FOR OPERATING LEVER

BACKGROUND OF THE INVENTION

1. Field of the Invention

This invention relates to an operating force controlling device for use with a construction equipment such as a crane, and more particularly to an operating force controlling device for providing an operation reactive force corresponding to a load pressure to an operating lever in order for an operator to sense initiation of movement of a suspended cargo with a hand manually when the suspended cargo is to be lifted or lowered.

2. Description of the Invention

A crane is equipped with a winch drum for lifting or lowering a suspended cargo, and a hydraulic motor for driving the drum is connected to the drum as disclosed in Japanese Utility Model Laid-Open No. 55-14199. The crane has a valve mechanism for controlling rotation of the motor. The valve mechanism includes a pilot valve connected to be operated by an operating lever, and a pilot type directional control device connected between the motor and a fluid supply source. When the lever of the crane is operated in the lifting direction, a pilot pressure is outputted from the pilot valve, and the directional control valve is changed over to its lifting position by the pilot pressure so that pressurized fluid is supplied from the fluid supply source to the motor. Then, the pressure (load pressure) on the fluid inlet side of the motor increases gradually, and when the load pressure exceeds a pressure corresponding to the magnitude of the load (load of the suspended cargo), the motor is activated to start the drum in its lifting direction. After that, the motor is driven with the load pressure corresponding to the magnitude of the load of the suspended cargo to carry out a lifting operation of the suspended cargo. Accordingly, if a change in load pressure of the motor is discriminated, then initiation of movement of the suspended cargo will be discriminated.

The crane disclosed in Japanese Utility Model Laid-Open No. 55-14199 mentioned above includes an operating force controlling device for enabling an operator to sense such change in load pressure of the motor with a hand which is operating the lever. The operating force controlling device includes a pilot valve connected to be operated by a lever, and a pair of cylinders operatively connected to the pilot valve for providing an operation reactive force to the lever. If the lever is operated to the lifting side to change over the directional control valve to cause the motor to rotate in order to lift a suspended cargo, the load pressure of the motor is inputted to a chamber of one of the cylinders by way of a corresponding one of pilot pipe lines from pipe lines communicating with ports on the opposite sides of the motor to push up a piston of the pilot valve and a rod connected to the piston. The rod is contacted with a pivotal position portion connected to the lever to urge the lever to return to its neutral position. An operation reactive force thus acts upon the lever. The operation reactive force increases in proportion to the load pressure of the motor. Accordingly, when an operator operates the lever, the load pressure of the motor can be sensed by sensing the operation reactive force by way of the lever.

However, the operating force controlling device has such a structure that the load pressure of the motor upon lifting and lowering of a suspended cargo is inputted directly to the chambers of the cylinders, and particularly when the load of the suspended cargo is heavy and the load pressure of the motor is high, the high pressure fluid will flow into the chambers of the cylinders. Accordingly, seal portions and so forth of the cylinders are required to have a sufficiently high strength to bear a high pressure. Consequently, the device is high in cost.

Further, the operating force controlling device is constituted such that the diameter (pressure receiving area) of the piston on the lifting operation side is equal to the diameter (pressure receiving area) of the piston of the lowering operation side, and as the load pressure is inputted to one of the chambers behind the pistons, the operation reactive force is controlled linearly at a fixed rate in proportion to the load pressure. However, when the suspended cargo is lowered, the load pressure varies only a little after changing over of the directional control valve until a counterbalance valve interposed between the directional control valve and the motor is opened, and after the counterbalance valve is opened and the suspended cargo starts to move in the lowering direction, the load pressure becomes substantially fixed irrespective of the magnitude of the load of the suspended cargo. Accordingly, even if the load pressure of the motor upon lowering operation is inputted to the chambers of the cylinders in the operating force controlling device, since the amount of change of the load pressure is small, the amount of change of the operation reactive force is so small that it is difficult to manually sense such change and accordingly it is difficult to manually sense initiation of movement in the lowering direction of the suspended cargo. On the other hand, when the suspended cargo is lifted, particularly where the load of the suspended cargo is small and the motor has a low load (the motor is in a region wherein the load pressure is low), the amount of change of the operation reactive force is so small that it is difficult to manually sense a change of the load pressure as a change of the operation reactive force. Accordingly, it is difficult to manually sense initiation of movement of the suspended cargo.

SUMMARY OF THE INVENTION

It is an object of the present invention to provide an operating force controlling device for an operating lever with which an operator can readily sense a change of an operating condition, particularly initiation of movement, of an actuator with a hand which is operating the lever.

It is another object of the present invention to provide an operating force controlling device for an operating lever which can employ a cylinder for a low pressure as a cylinder of a reactive force mechanism and can be produced at a reduced cost.

It is a further object of the present invention to provide an operating force controlling device for an operating lever wherein the control accuracy of an operation reactive force is improved to facilitate sensing of a change of an operation reactive force, that is, a change of a load pressure.

It is still further object of the present invention to provide an operating force controlling device for an operating lever which can control an operation reactive force in accordance with the nature of an operation to improve the general usefulness of the device.

An operating force controlling device of the present invention is applied to a construction equipment, particularly to a crane which includes a winch drum for lifting and lowering a suspended cargo and a motor connected to drive the drum. The operating force controlling device comprises a valve mechanism for controlling supply and discharge of fluid to and from an actuator, particularly a hydraulic motor, and an operating lever for changing over the valve mechanism. The valve mechanism may include a pilot valve on which the operating lever is provided, and a pilot type directional control valve connected between a fluid supply source and the motor, the secondary side of the pilot valve being connected to a signal receiving portion of the pilot type directional control valve by way of a pilot pipe line.

The lever may be supported for pivotal motion on a valve body of the pilot valve and alternatively operated in two directions to a lifting side and a lowering side. When the lever is operated in the lifting direction, a pilot pressure is outputted from the pilot valve, and the directional control valve is changed over to the lifting position by the pilot pressure. Consequently, pressurized fluid is supplied from the fluid supply source to the motor to rotate the motor in the lifting direction, and consequently, the drum is rotated in the lifting direction to lift the suspended cargo. When the lever is operated reversely in the lowering direction, the suspended cargo will be lowered. Upon lifting or lowering operation of the suspended cargo, the pressure (load pressure) on the fluid inlet side of the motor rises to drive the motor. The load pressure varies in response to an operating condition of the motor such as, for example, a magnitude of the load of the suspended cargo or an operating direction for lifting or lowering.

In order to enable an operator to readily sense such a change of the load pressure of the motor with a hand, the operating force controlling device of the present invention comprises a reactive force mechanism for applying to the operating lever a force in the direction opposite to the direction of the operation of the operating lever (operation reactive force). The operating force controlling device of the present invention may comprise two such reactive force mechanisms provided in an opposing relationship to each other at the opposite ends of a pivotal portion of the lever in order to apply, for each of the two operating directions of the lever, a reactive force in the direction opposite to the direction of operation of the lever. The reactive force mechanism may include a cylinder having a chamber for control of the operation reactive force, a piston supported for axial sliding movement in the cylinder, and a rod connected to the piston and disposed in an opposing relationship to a pivotal member connected to the lever. In the operating force controlling device of the present invention, preferably the cylinder of the reactive force mechanism is formed in an integral relationship with the valve body of the pilot valve.

The operating force controlling device of the present invention comprises, in order to control such that the operation reactive force by the reactive force mechanism may vary in response to an operating condition of the motor, means for detecting an operating condition of the motor, and a control mechanism connected between the detecting means and the reactive force mechanism. The control mechanism receives a signal from the detecting means and delivers a reactive force controlling signal corresponding to the received signal to the reactive force mechanism.

The means for detecting an operating condition of the motor may include a pair of pressure sensors connected to pipe lines which communicate with a pair of ports for supplying and discharging fluid into and from the motor therethrough. The pressure sensors individually detect a load pressure on the lifting side and a load pressure on the lowering side of the motor. The control mechanism may a controller for receiving a signal from the detecting means and for developing a reactive force controlling signal in response to a direction of rotation of the motor and a magnitude of the load pressure, and a signal outputting means for outputting control fluid in accordance with a signal from the controller to the reactive force mechanism. The signal outputting means may be an electromagnetic proportional pressure reducing valve for outputting to the chamber of the cylinder a pilot pressure in response to an electric controlling signal from the controller.

In the operating force controlling device of the present invention, when the lever is operated to the lifting or lowering direction to rotate the motor in the lifting or lowering direction to carry out a lifting or lowering operation of a suspended cargo, pressures in the pipe lines which communicate with the ports on the opposite sides of the motor are detected individually by the pressure sensors and inputted to the controller. The controller discriminates lifting or lowering and calculates an effective load pressure of the motor from pressure values detected by the pressure sensors. The controller then outputs a reactive force controlling signal in accordance with the effective load pressure, and a pilot pressure is outputted from the electromagnetic proportional pressure reducing valve in response to the control signal. The pilot pressure is inputted to the chamber of the cylinder of the reactive force mechanism so that the piston and the rod are pushed up to apply an operation reactive force corresponding to the load pressure to the lever. The pilot pressure inputted to the chamber is lower than the load pressure of the motor. Accordingly, a seal and so forth of the cylinder used may be those for a low pressure. Further, as a pilot pressure is inputted to the chamber to control the operation reactive forces, the control accuracy of the operation reactive force is improved, enabling delicate reactive force control.

In the operating force controlling device, preferably a change-over valve is connected to the primary side of the electromagnetic proportional pressure reducing valve. The change-over valve is constructed for shifting movement between a position in which the primary side of the electromagnetic proportional pressure reducing valve is connected to the pilot pressure source and another position in which the primary side is connected to a reservoir. When control of the operation reactive force is required, the primary side of the electromagnetic proportional pressure reducing valve is connected to the pilot pressure source by way of the change-over valve, but when control of the operation reactive force is not required, such as when the lever is operated frequently, the primary side is connected to the reservoir by way of the change-over valve.

The operating force controlling device of the present invention may be controlled such that the rate of change of the operation reactive force to a load pressure of the motor may be high in a light load condition but may be low in a heavy load condition. Particularly when the load is light in a lifting operation of a suspended cargo, even if the load pressure of the motor varies only a little, the operation reactive force changes to a great extent so that such small change of the load pressure can be sensed by an operator, which facilitates sensing of a change of the operating condition of the suspended cargo, particularly sensing of initiation of movement of the suspended load upon lifting. On the other hand, the load is light also upon lowering of the suspended cargo, and accordingly, also upon lowering, the load pressure of the motor which varies a little at an initial stage of changing over of the directional control valve irrespective of the magnitude of the load of the suspended cargo is converted into a great operation reactive force so that an operator can sense a change of the operation reactive force with high sensitivity. Consequently, initiation of movement of the suspended cargo upon lowering is sensed with certainty.

In the operating force controlling device, if it is assumed that the rate of change of the operation reactive force corresponding to the load pressure of the motor is constant and is so left when the motor has a heavy load, particularly when the load of a suspended cargo in a lifting operation is heavy, to be high similarly as in the case of the light load condition described above, then the operation reactive force will be excessively great as the load pressure increases, and there is a possibility that the operation reactive force may exceed an allowable maximum value of the lever. However, the operating force controlling device of the present invention is controlled such that, when the load to the motor is heavy, the rate of change of the operation reactive force may be decreased while the operation reactive force itself is increased in response to the load pressure. Thus, the maximum value of the operation reactive force is prevented from exceeding the allowable maximum value by the lever.

The operating force controlling device of the present invention may comprise, in order to improve the general usefulness of the device, an initial value setting means for changing an initial value of the reactive force controlling signal in accordance with the type of an operation. For example, when the load pressure of the motor is small, the initial value is set to a high value. Consequently, a high operation reactive force can be obtained even from a low load pressure, and a change of the load pressure in a light load region can be sensed more readily.

The operating force controlling device of the present invention may comprise, in order to further improve the general usefulness of the device, a control mechanism for controlling with a plurality of control patterns having different rates of change of the operation reactive force corresponding to a load pressure of the motor, the control mechanism including a control pattern selecting means therein. The control patterns are divided into a control pattern or patterns for control upon lifting of a suspended cargo and a control pattern or patterns for control upon lowering, and the rate of change is controlled such that it may be higher in the control pattern or patterns for control upon lowering than in the control pattern or patterns for control upon lifting. The controllability, particularly upon lowering, is improved by such control.

In the operating force controlling device of the present invention, the control patterns for control upon lifting are divided into a plurality of patterns, and in at least one of the control patterns, the rate of change of the operation reactive force corresponding to a load pressure of the motor in a light load condition is set such that it may be higher than the rate of change of the operation reactive force corresponding to a load pressure of the motor in a heavy load condition. With the device, an optimum pattern is selected from among the control patterns to accomplish control of the operation reactive force appropriately.

The operating force controlling device of the present invention may be constructed otherwise in the following manner.

The cylinder of the reactive force mechanism is formed independently of the valve body of the pilot valve but is connected in an integral relationship to a side face of the valve body by means of a connecting element.

The cylinder of the reactive force mechanism and the pilot valve are constructed independently of each other and disposed at different positions spaced from each other, and the pivotal portion of the operating lever of the pilot valve is connected to the pivotal portion of the reactive force mechanism by way of a link. Where a cage is small as in a construction equipment, the reactive force mechanism and the pilot valve can be constructed such that they may not disturb to operation by disposing them in a spaced relationship from each other.

The means for detecting an operating condition of the actuator may include a shuttle valve connected to the pipe lines which communicate with the two ports provided for supplying and discharging fluid into and from the actuator, and a single pressure sensor connected to the shuttle valve for detecting a higher pressure selected by the shuttle valve. Load pressures both upon operation of the actuator in one direction and upon operation in the other direction are detected by the single pressure sensor. In this instance, means for detecting a direction of operation of the operating lever may be provided if necessary. The means may be a switch mechanism of the on-off type such as, for example, a limit switch, and such switch mechanism detects the direction of operation of the operating lever to detect a direction of operation of the actuator. Or as another means, a pressure detecting means may be connected to at least one of the two pilot pipe lines connected between the two secondary side ports of the pilot valve and the signal receiving portions on the opposite ends of the pilot type directional control valve such that the direction of operation of the lever and the direction of operation of the actuator may be discriminated in response to a value detected by the detecting means.

The operating force controlling device for an operating lever of the present invention has the following advantages. In particular, the operating force controlling device can control the operation reactive force in response to an operating condition of the actuator. The operating force controlling device of the present invention can employ a cylinder for a low pressure for the cylinders of the reactive force mechanism since the control mechanism for inputting a control signal to the reactive force mechanism is constructed from a controller and an electromagnetic proportional pressure receiving valve. Further, compared with an alternative arrangement wherein the load pressure of the motor is inputted directly to the cylinder of the reactive force mechanism to effect control, the device can be produced at a reduced cost and with reduced failures to improve the life of the machine. Besides, delicate control becomes available and the control accuracy can be improved.

The operating force controlling device of the present invention detects a load pressure of the actuator and controls the operation reactive force in response to the load pressure by means of the reactive force mechanism, and particularly in control of the operation reactive force, since the rate of change of the operation reactive force to the load pressure is high in a light load condition, an operator can certainly sense even a small change of the load pressure as a great changes of the operation reactive force. Further, as the operator senses the operation reactive force, initiation of movement of the load (suspended cargo) can be discriminated readily, and accordingly, safety can be improved. Since the operating force controlling device of the present invention does not control the operation reactive force at a fixed ratio but controls, when the load is heavy, the operation reactive force at a smaller rate of change than that when the load is light, the operation reactive force will not exceed an available maximum value of the lever when the load is heavy, and operation of the lever can be carried out smoothly.

The operating force controlling device of the present invention can perform various controls, and the general usefulness of the device can be improved where a plurality of control patterns are set. The operating force controlling device is controlled such that the rate of change of the operation reactive force may be high in an lowering operation of a suspended cargo but low in a lifting operation. Then, upon lowering of the suspended cargo, the load pressure of the motor which varies a little at an initial stage of changing over of the directional control valve can be changed into a great change of the operation reactive force, and consequently an operator can sense the change with high sensitivity. Accordingly, even when the operator operates at a position at which the suspended cargo cannot be observed, initiation of movement of the suspended cargo in the lowering direction can be manually sensed with certainty and accordingly, safe operation is assured. The operating force controlling device can always assure appropriate operation reactive force control by selecting a control pattern suitable for the type of operation by means of the control pattern selecting means.

The operating force controlling device of the present invention can arbitrarily set an initial value of the operation reactive force by means of the initial value setting means. Consequently, the controllability in a light load condition can be further improved, and initiation of movement of the suspended cargo can be recognized more readily.

Where the load pressure is detected using the shuttle valve and the single pressure sensor, the operating force controlling device of the present invention can be produced at a reduced cost compared with an alternative arrangement wherein the pressures on the opposite sides of the motor are detected by two pressure sensors, because one of such pressure sensors can be omitted.

DESCRIPTION OF THE PREFERRED EMBODIMENTS

Figure 1:
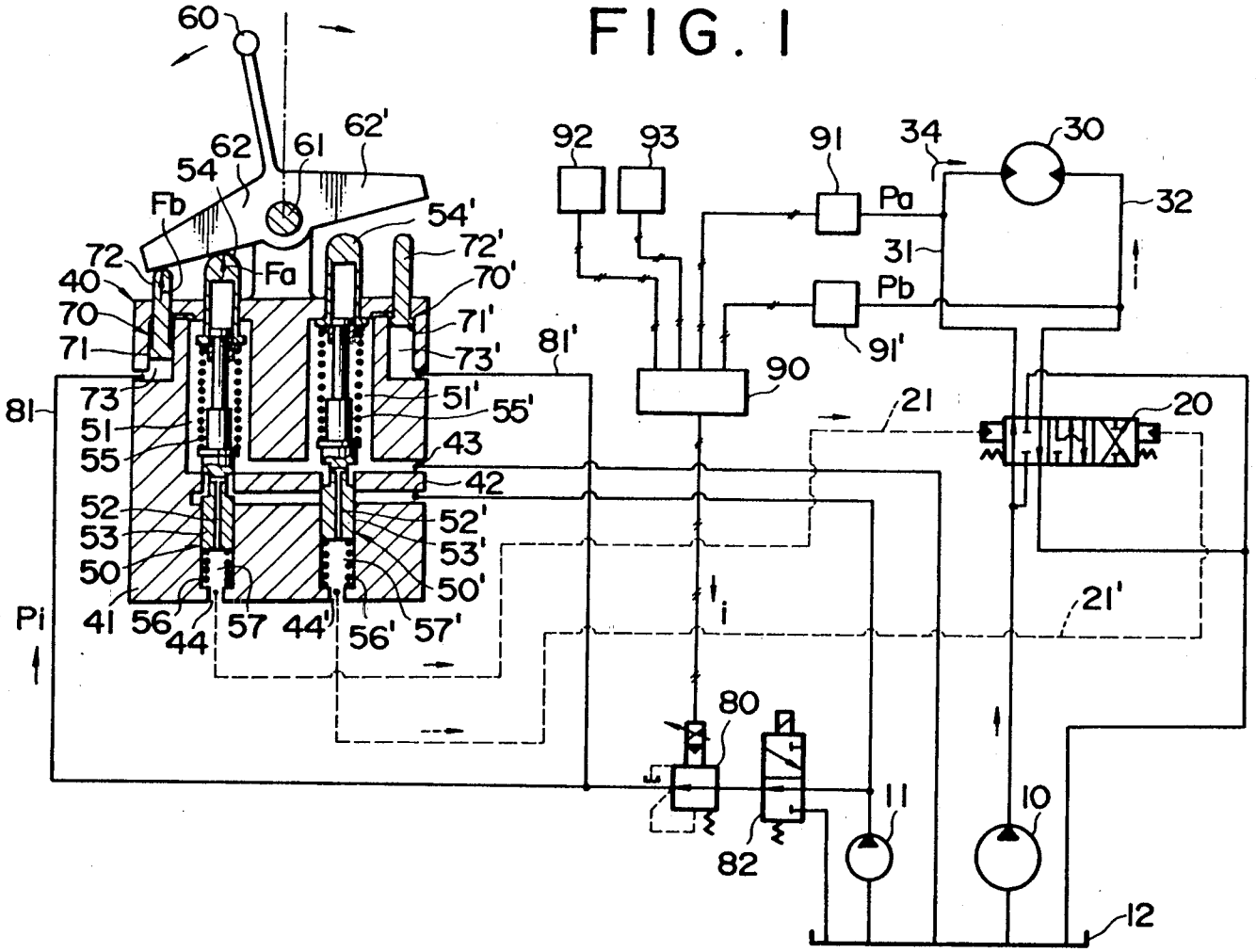
FIG. 1 is a diagrammatic representation of an operating force controlling device showing a preferred embodiment of the present invention.

Referring first to FIG. 1, a hydraulic motor 30 is connected to a winch drum (not shown) of a crane (not shown). When the motor 30 is rotated forwardly or reversely, the winch drum is rotated forwardly or reversely to perform lifting or lowering of a suspended cargo. An operating force controlling device of the present invention includes a valve mechanism for controlling rotation of the motor 30. The valve mechanism includes a pilot type directional control valve 20 and a pilot valve 40. The directional control valve 20 is connected between a main pump 10 serving as a fluid supply source and the motor 30 such that pressurized fluid discharged from the pump 10 may be supplied to the motor 30 to rotate the motor 30 forwardly or reversely in accordance with a shifted position of the directional control valve 20. A known counterbalance valve (not shown) is provided between the motor 30 and the directional control valve 20.

The pilot valve 40 has a pair of pressure reducing valves 50 and 50' disposed for operation by an operating lever 60. The lever 60 is supported for pivotal motion on a valve body 41 by means of a pivot shaft 61. A pair of pivotal members 62 and 62' are provided in an integral relationship on the lever 60 so that they may be pivoted in an integral relationship with the lever 60. The pressure reducing valves 50 and 50' are provided in an opposing relationship to the pivotal members 62 and 62', respectively. The valve body 41 has a pair of chambers 51 and 51', an input port 42 communicating with the chambers 51 and 51', a return port 43, and a pair of output ports 44 and 44'. Spools 53 and 53' of the pressure reducing valves 50 and 50' are inserted for sliding movement in the chambers 51 and 51', respectively. A pair of springs 56 and 56' are accommodated in chambers 57 and 57' and support lower or rear ends of the spools 53 and 53' thereon. respectively. The chambers 57 and 57' are communicated with the ports 44 and 44', respectively. A pair of push rods 54 and 54' are supported for axial movement in the valve body 41 such that upper or front ends thereof may oppose to the pivotal members 62 and 62', respectively, while lower or rear ends thereof are engaged for axial sliding movement with upper or front ends of the spools 53 and 53', respectively. A pair of springs 55 and 55' are disposed between flanges provided on the spools 53 and 53' and lower or rear ends of the push rods 54 and 54', respectively, and urge the push rods 54 and 54' in a direction to project from the valve body 41, respectively. In order to prevent the push rods 54 and 54' from falling off from the valve body 41, flanges for abutting with walls of the chanbers 51 and 51' on the upper or front end side are provided at the lower or rear ends of the push rods 54 and 54'. The port 42 is connected to a pilot pump 11 while the port 43 is connected to a reservoir 12, and the ports 44 and 44' are connected to changing over signal receiving portions of the directional control valve 20 by way of a pair of pilot pipe lines 21 and 21', respectively.

FIG. 1 shows the operating force controlling device in a condition when the lever 60 of the pilot valve 40 is operated from its neutral position to its lifting position. Upon such operation, the push rod 54 of the pressure reducing valve 50 on the lifting side is pushed down by the pivotal member 62 and hence the spool 53 is pushed down. In this instance, fluid (primary pressure) discharged from the pilot pump 11 and adjusted to a predetermined pressure by a pilot relief valve (not shown) or the like is inputted to the input port 42 of the pilot valve 40. Thus, as the spool 53 of the pressure reducing valve 50 is pushed down, a pilot pressure is outputted from the port 44 into the pilot pipe line 21, and the directional control valve 20 is changed over to its lifting position by the pilot pressure. Consequently, pressure fluid discharged from the pump 10 is flowed in the direction indicated by an arrow mark 34 into the motor 30 so that the motor 30 is rotated forwardly to rotate the winch drum (not shown) in the lifting direction to lift the suspended cargo.

The operating force controlling device of the present invention includes, in order to enable an operator to manually sense an operating condition of the motor 30, that is, movement of the suspended cargo, such a reactive force mechanism and a control mechanism for the reactive force mechanism as described below. The reactive force mechanism includes a pair of cylinders 70 and 70', a pair of pistons 71 and 71' inserted for axial sliding movement in the cylinders 70 and 70', respectively, and a pair of rods 72 and 72' connected to the pistons 71 and 71', respectively. The cylinders 70 and 70' are formed in an integral relationship on the valve body 41 of the pilot valve 40 adjacent the pressure reducing valves 50 and 50', respectively, of the pilot valve 40, and the rods 72 and 72' are disposed in an opposing relationship to the pivotal members 62 and 62', respectively. When the lever 60 assumes its neutral position, upper or front ends of the rods 72 and 72' contact with the pivotal members 62 and 62', respectively.

The control mechanism described above includes a controller 90 and an electromagnetic proportional pressure reducing valve 80. The electromagnetic proportional pressure reducing valve 80 is alternatively connected, on the primary side thereof, to the pilot pump 11 and the reservoir 12 by way of a change-over valve 82. When the operation reactive force is to be controlled, the valve 80 is connected on the primary side thereof to the pump 11 by way of the change-over valve 82 and receives an electric reactive force controlling signal (electric current) from the controller 90 while it outputs, on the secondary side thereof, a pilot pressure corresponding to the signal received. The secondary side of the valve 80 is connected to a pair of chambers 73 and 73' by way of a pair of pilot pipe lines 81 and 81', respectively.

In order to detect an operating condition of the motor 30, a pair of pressure sensors 91 and 91' are connected to oil passages 31 and 32, respectively, communicating with a pair of ports on the opposite sides of the motor 30. Thus, a load pressure Pa on the lifting side and another load pressure Pb on the lowering side of the motor 30 are individually detected by the sensors 91 and 91', respectively, and are inputted to the controller 90. Where required, an initial value setting means 92 and/or a switch 93 for selection of a control pattern are connected to signal receiving means of the controller 90.

If the lever 60 is operated to the lifting side as shown in FIG. 1 to cause the motor 30 to rotate to the lifting side, then the load pressure Pa of the oil passage 31 on the lifting side of the motor 30 is detected by the pressure sensor 91 and inputted to the controller 90. The controller 90 comprises reative sorce controlling means which outputs a reactive force controlling signal i (electric control current) to the electromagnetic proportional pressure reducing valve 80 in accordance with the load pressure Pa. The electromagnetic proportional pressure reducing valve 80 outputs to the pipe line 81 a pilot pressure Pi proportional to the controlling signal. The pilot pressure Pi is inputted to the chamber 73 by way of the pipe line 81, and the rod 72 is urged by the pilot pressure Pi so that it may be projected from the valve body 41 of the pilot valve 40. Thus, the projecting force acts as an operation reactive force Fa to the pivotal member 62 of the lever 60.

The lever 60 is normally acted upon by a force which tends to return the push rod 54 of the pressure reducing valve 50 to its neutral position as a peculiar reactive force Fo. Accordingly, when the lever 60 is operated, the sum of the operation reactive force Fa which is controlled in accordance with the load pressure Pa and the peculiar reactive force Fo acts as a total reactive force F ($F=Fo+Fa$) upon the lever 60. Here, the peculiar reactive force Fo depends upon the spring 56 of the pressure reducing valve 50 of the pilot valve 40 and a resistance to sliding movement of the spool 53 and so forth and is substantially constant at a certain lever stroke. To the contrary, the operation reactive force Fa by the rod 72 is basically controlled in accordance with the load pressure Pa of the motor 30. Further, the rate of change (proportional gain) of the operation reactive force Fa with respect to the load pressure Pa is controlled by a controlling means such as an arithmetic unit provided in the controller 90 such that it may be high when the load is light but may be low when the load is heavy.

Figure 2:
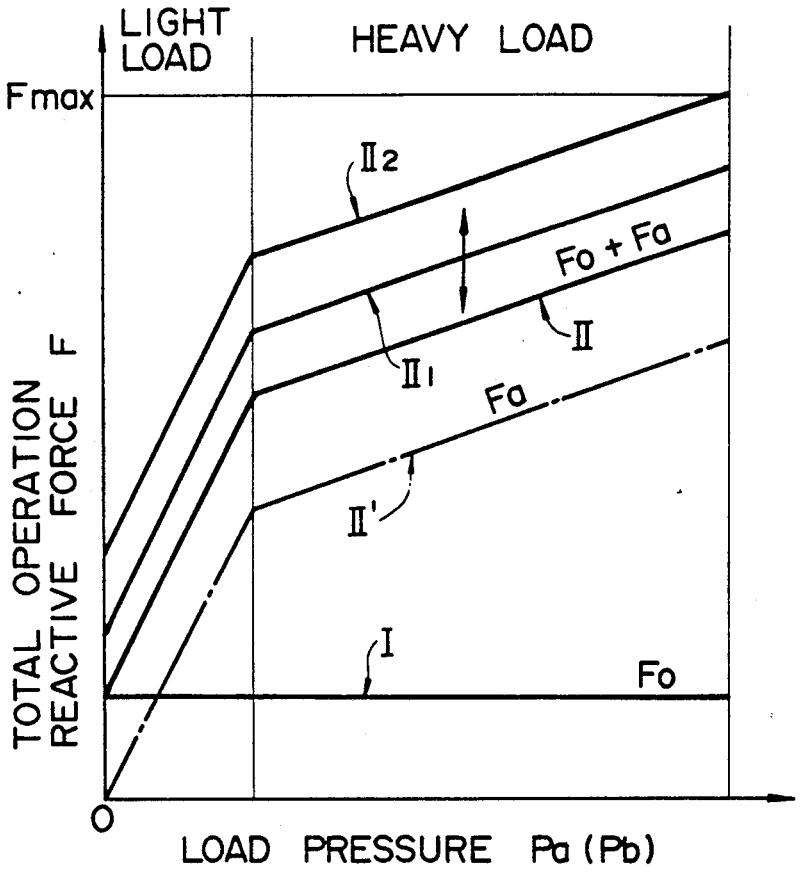
FIG. 2 is a diagram illustrating a relationship between a load pressure and an operation reactive force when the operation reactive force is controlled by the operating force controlling device shown in FIG. 1.

FIG. 2 is a diagram illustrating a relationship of the operation reactive forces Fa and F acting on the lever 60 to the load pressure Pa of the motor 30. Referring to FIG. 2, a solid line I indicates a peculiar reactive force Fo (constant) of the pressure reducing valve 50; a chain line II' indicates an operation reactive force Fa which is controlled in accordance with the load pressure Pa; and a solid line II indicates a total operation reactive force F ($Fo+Fa$) which actually acts upon the lever 60. In a lifting operation described hereinabove, the rate of change of the operation reactive force Fa is controlled in accordance with such a bent line that it may be high when the load pressure Pa is low but may be low when the load pressure Pa is high as seen from the solid line II'.

Due to such control, particularly when the load is light, a small change of the load pressure Pa can be converted into a great change of the operation reactive force Fa, and the great change can be manually sensed with high sensitivity by an operator who is operating the lever 60. Further, the operator can sense initiation of movement of the load at an initial stage of its operation through a change of the operation reactive force Fa, that is, through a change of the total operation reactive force F. In the meantime, even if the rate of change of the operation reactive force Fa with respect to the load pressure Pa is raised when the load is light as described above, since the rate of change is lowered when the load is heavy, there is no possibility that the total operation reactive force F may exceed an available maximum value Fmax for the lever, and even when the load is heavy, the operation reactive force Fa can be controlled appropriately in accordance with the load pressure Pa. Consequently, smooth operation can be assured over an entire load region ranging from a light load condition to a heavy load condition.

Subsequently, when the lever 60 is operated in the lowering direction, a pilot pressure is outputted from the pressure reducing valve 50' on the lowering side, and the directional control valve 20 is changed over to the lowering position. Consequently, the motor 30 is rotated in the lowering direction. In this instance, a pressure (load pressure) Pb of the oil passage 32 on the lowering side is detected by the pressure sensor 91'. Then, the operation reactive force is controlled in a similar manner as described above by the controller 90, electromagnetic proportional pressure reducing valve 80, cylinder 70' of the reactive force mechanism and so forth. In the lowering operation, however, since the load pressure Pb of the motor 30 is low as described hereinabove, the operation is made for a light load. Accordingly, the rate of change of the operation reactive force Fb with respect to the load pressure Pb is high, and therefore, the operation reactive force Fb is controlled such that it may vary to a great extent even if the load pressue Pb varies a little. As a result, the operator can manually sense with high sensitivity by the hand which is operating the lever 60, and initiation of movement of the load at an initial stage operation can be sensed readily through a change of the operation reactive force Fb, that is, a change of the total operation reactive force F. Particularly when, in a lowering operation, a suspended charge is hidden, for example, behind a building and the operator must operate at a position at which the suspended cargo cannot be observed, the operation can be proceeded in safety by sensing the operation reactive force F (Fb) with a hand to discriminate initiation of movement of the suspended cargo as described above.

Where the pressures of the oil passages 31 and 32 on the opposite sides of the motor 30 are individually detected using the two pressure sensors 91 and 91' as shown in FIG. 1 and inputted to the controller 90 in which lifting or lowering operation is distinguished and a difference in pressure between the oil passages 31 and 32 is calculated and such control as described above is executive in accordance with an effective load pressure of the motor 30 obtained from the calculated difference in pressure, and particularly where the winch circuit is connected to another actuator circuit by way of a series circuit, even if the downstream actuator is being used, the operation reactive force can be controlled appropriately.

The operating force controlling device of the present invention may control also in the following manner.

As shown in FIG. 1, an initial value setting device 92 may be connected to the controller 90. By changing the initial value of control by means of the initial value setting device 92, the control pattern indicated by the solid line II shown in FIG. 2 is changed to another control pattern indicated by a solid line $II_1$ to $II_2$. The initial value may be shifted up or down at a plurality of stages or may be changed infinitely. By such change of the initial value, the operation reactive force particularly in a light load condition can be increased, and the facility in operation can be improved further.

Figure 3:
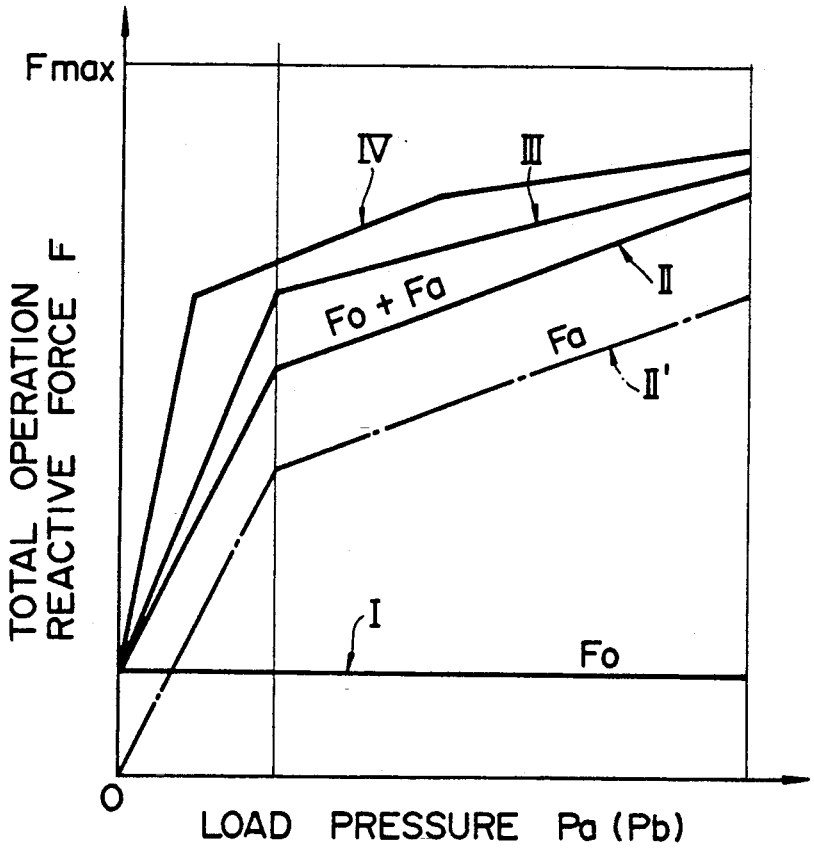
FIG. 3 is a diagram illustrating a relationship between a load pressure and an operation reactive force when the operation reactive force is controlled with a plurality of control patterns by the operating force controlling device shown in FIG. 1.

Such a plurality of control patterns as indicated by solid lines II, III and IV in FIG. 3 may be set or stored in the controller 90 of FIG. 1. Meanwhile, a selection switch 93 serving as a control pattern selecting means may be provided for the controller 90. The control patterns of the solid lines II, III and IV are different in rate of change of the operation reactive force from each other and individually have different rates of change of the operation reactive force in a light load condition and in a heavy load condition. Then, that one of the control patterns indicated by the solid lines II, III and IV which corresponds to the type of operation is selected by means of the selection switch 93. Consequently, the operation reactive force can be controlled appropriately in accordance with the type of operation.

Figure 4:
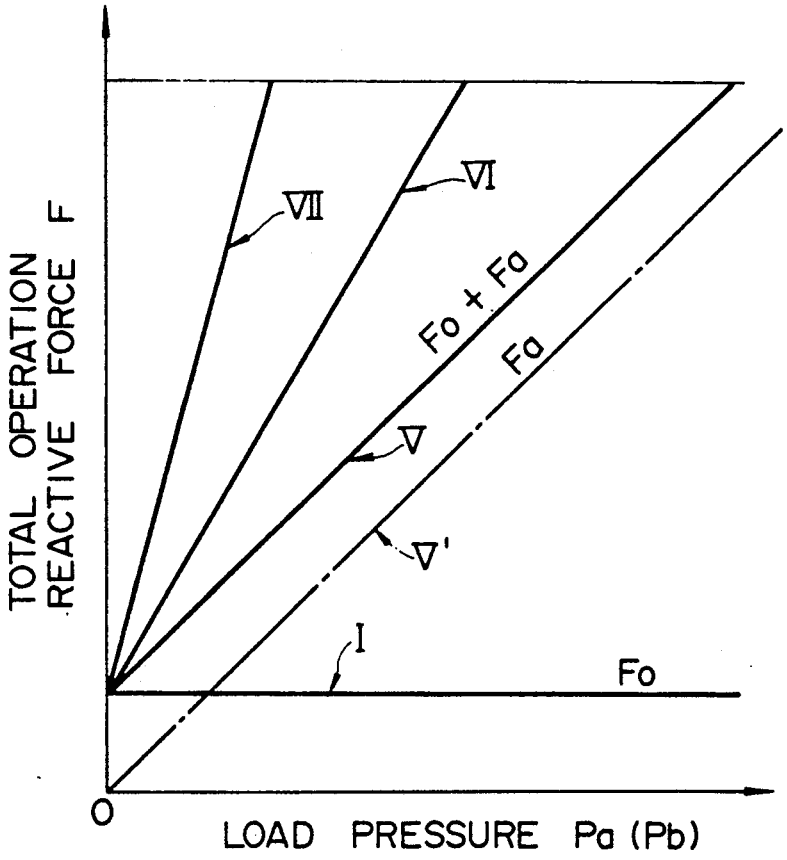
FIG. 4 is a diagram illustrating a relationship between a load pressure and an operation reactive force when the operation reactive force is controlled in a different manner with a plurality of control patterns by the operating force controlling device shown in FIG. 1.

The control patterns stored in the controller 90 need not necessarily make such bent lines as described above. For example, such three control patterns wherein the operation reactive force presents a linear change and the rate of change thereof is fixed as indicated by solid line V, VI and VII in FIG. 4 may be set or stored in the controller 90. Thus, one of the three control patterns is selected in accordance with a load (magnitude of the load of the suspended cargo) by the selection switch 93 such that the control pattern given by the solid line V may be selected in a heavy load operation: the solid line VI may be selected in a medium load operation: and the solid line VII may be selected in a light load operation. Due to such selection, the operation reactive force can be controlled in accordance with the type of operation, and the general usefulness of the device can be improved.

Figure 5:
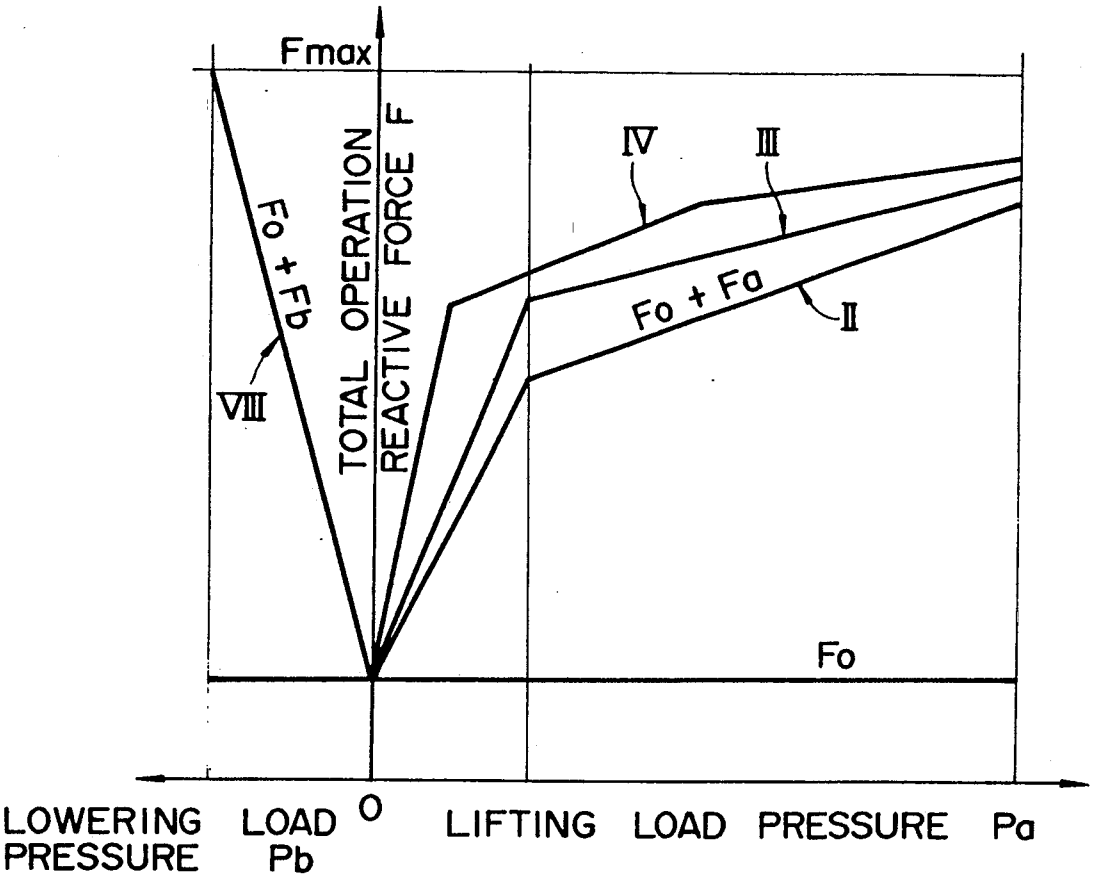
FIG. 5 is a control characteristic diagram illustrating a relationship between a load pressure and an operation reactive force when the operation reactive force is controlled with different control patterns for lifting and for lowering by the operating force controlling device shown in FIG. 1.

Such control patterns as indicated by solid lines II, III and IV in FIG. 5 may be set or stored for control for a lifting operation in the controller 90 while such an additional control pattern for lowering as indicated by a solid line VIII in FIG. 5 is set or stored in the controller 90. It is to be noted that the control pattern VIII for lowering is set such that the rate of change of the operation reactive force with respect to the load pressure is higher than the rates of change of the operation reactive force for lifting. Thus, a control pattern is selected by the selecting switch 93 in accordance with a lifting operation or an lowering operation. Such selection facilitates sensing of a change of the load pressure particularly upon lowering and thus facilitates sensing of initiation of movement of a suspended cargo.

Further, initial values of the control patterns indicated by the solid line II, III and IV (FIG. 3) and/or the solid line V, VI and VII (FIG. 4) and the solid line VIII (FIG. 5) may be changed by the initial value setting device 92. It is to be noted that the intended objects can be attained even if the initial value setting device 92 and the control pattern selecting switch 93 are omitted.

Although a primary pressure is inputted to the electromagnetic proportional pressure reducing valve 80 so that such operation reactive force control as described above is executed if the change-over valve 82 is held at the position shown in FIG. 1, when no control of the operation reactive force is required such as, for example, during an operation wherein the lever is operated frequently, if the change-over valve 82 is changed over to its upper position in FIG. 1, then the electromagnetic proportional pressure reducing valve 80 is communicated with the reservoir 12. Consequently, the operation reactive force control is canceled. The change-over valve 82 may then be omitted.

Figure 6:
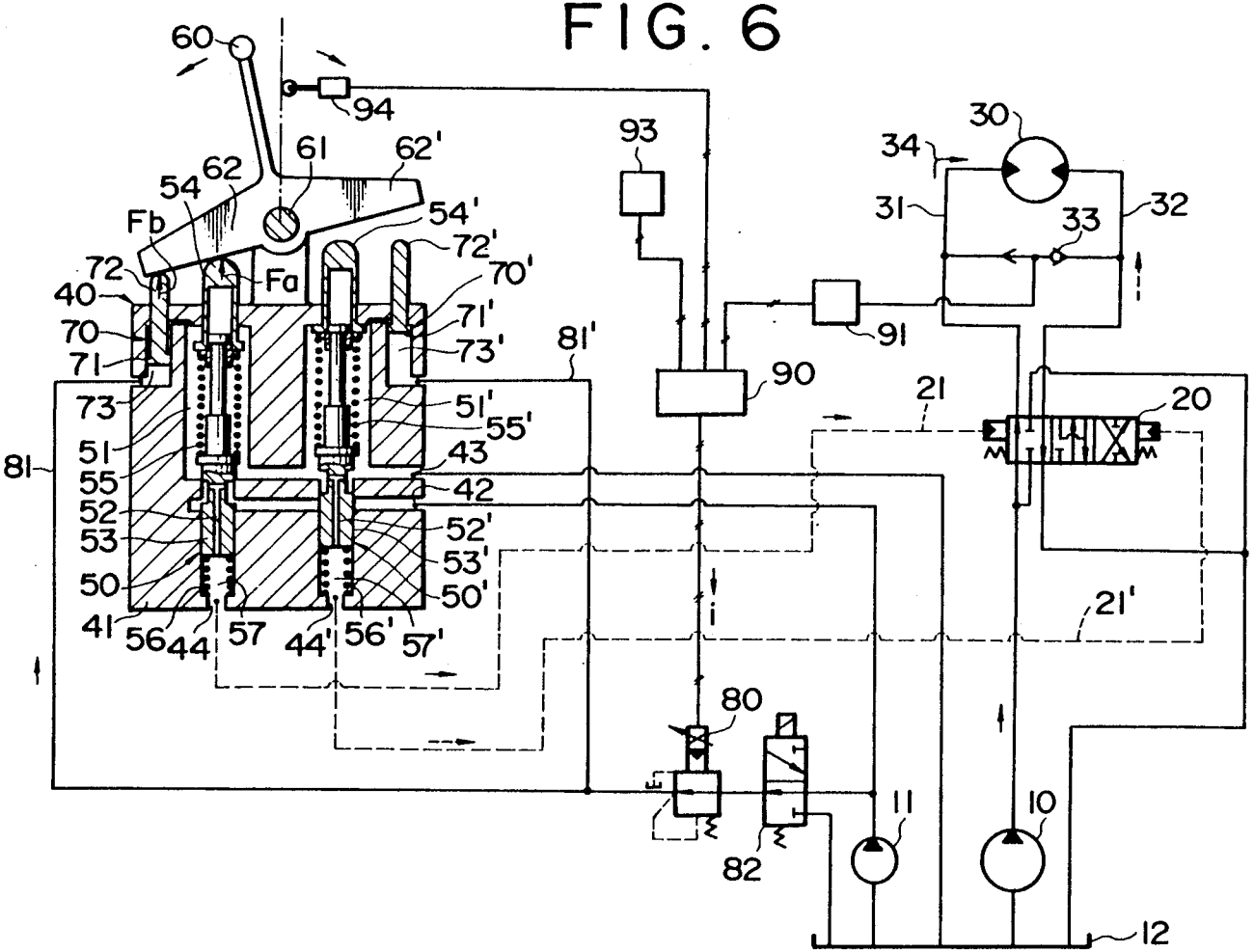
FIG. 6 is a diagrammatic representation of a modification to the operating force controlling device of FIG. 1 wherein an operating condition of a motor is detected by a different means.

Referring now to FIG. 6, there is shown a modification to the operating force controlling device of FIG. 1 wherein a different detecting means is employed. In the modified operating force controlling device, a higher one of the pressures of the oil passages 31 and 32 on the opposite sides of the motor 30 is selected by means of a shuttle valve 33 and detected by a single pressure sensor 91 to effect intended control. In the case of the modified operating force controlling device, a switch 94 for detecting the direction of operation of the lever 60 may be provided where required. The switch 94 is mounted on a support member which may be, for example, the valve body 41 of the pilot valve 40 and detects the direction of operation of the lever 60. The detected value is inputted to the controller 90 so that the direction of operation of the motor 30 may be discriminated by the controller 90.

Figure 7:
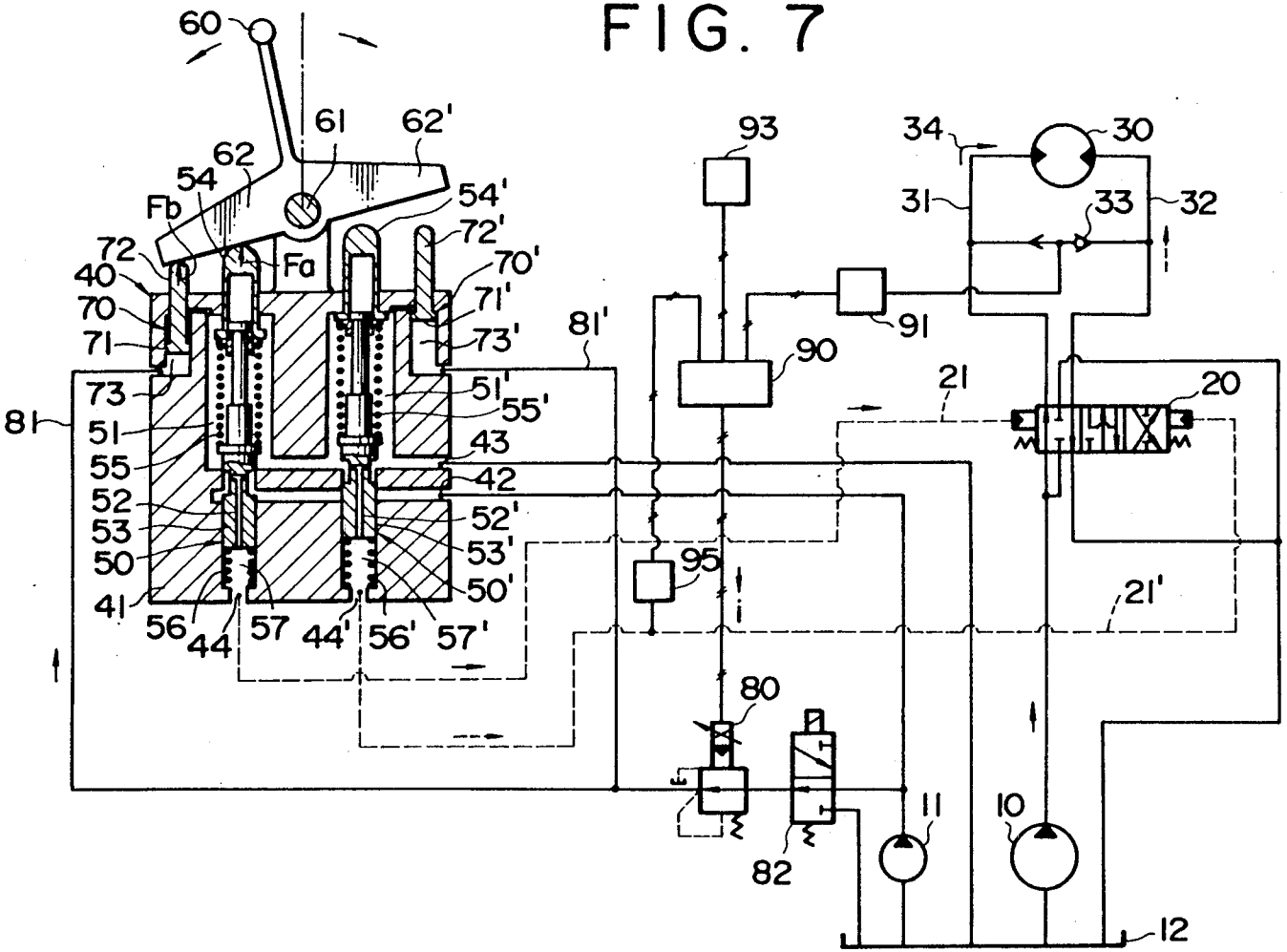
FIG. 7 is a similar view but showing another modification to the operating force controlling device of FIG. 1 wherein an operating condition of a motor is detected by another different means.

Referring now to Fig. 7, there is shown a modification to the modified operating force controlling device of FIG. 6 wherein another different means for detecting the direction of operation of the lever 60 is provided. In the modified arrangement shown, a pressure switch 95 is connected to one 21 of the pilot pipe lines 21 and 21' connected between the ports 44 and 44' of the pilot valve 40 and the signal receiving portions on the opposite sides of the directional control valve 20. Thus, a pilot pressure is detected by means of the switch 95 to detect the direction of operation of the lever 60, that is, the direction of operation of the motor 30.

Figure 8:
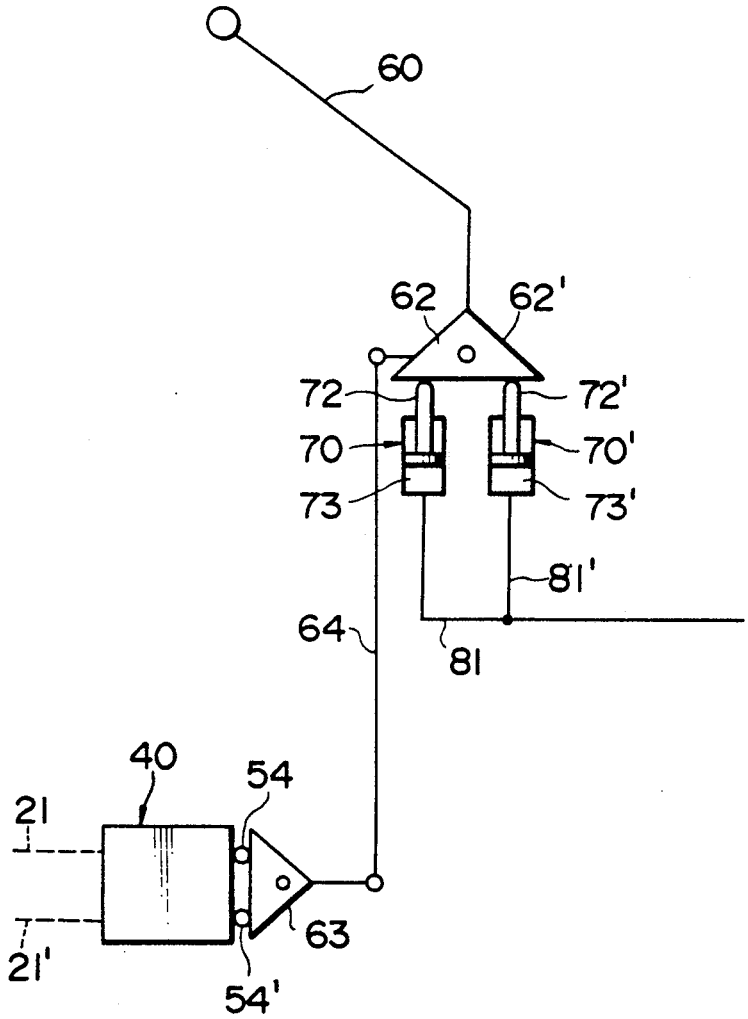
FIG. 8 is a diagrammatic representation showing part of a further modification to the operating force controlling device of FIG. 1 wherein a pilot valve and a reactive force mechanism are provided in a separate, spaced relationship from each other.

By the way, while the cylinders 70 and 70' of the reactive force mechanism are provided in an integral relationship with the pilot valve 40 in any of the operating force controlling devices shown in FIGS. 1, 7 and 8, they need not necessarily be formed in an integral relationship on the pilot valve 40.

In particular, the cylinders 70 and 70' of the reactive force mechanism and the pilot valve 40 may otherwise be provided separately from each other as shown in FIG. 8. Referring to FIG. 8, the cylinders 70 and 70' are supported on a support member at a location spaced from the pilot valve 40, and the lever 60 is supported for pivotal motion on the support member such that the pivotal members 62 and 62' connected to the lever 60 may be opposed to the rods 72 and 72' of the cylinders 70 and 70', respectively. The pivotal members 62 and 62' are operatively connected to an operating portion 63 of the pilot valve 40 by way of a link 64 or the like. Due to the structue, if the lever 60 is operated, then one of the rods 72 and 72' of the cylinders 70 and 70' and one of the pressure reducing valves of the pilot valve 40 at the location spaced from the cylinders 70 and 70' are operated at the same time to carry out lifting or lowering of a suspended cargo while an operation reactive force corresponding to the load pressure is applied to the lever 60. Particularly where such construction as shown in FIG. 8 is employed, a known or existing pilot valve can be used as it is, and the cylinders 70 and 70' of the reactive force mechanism can be reduced in size, permitting reduction in production cost. Besides, the arrangement of the pilot valve 40 and the operating lever 60 as well as the cylinders 70 and 70' can be set arbitrarily, and accordingly, they can be disposed efficiently in a small cage as in a construction equipment to raise the utilization value.

The operating force controlling device of the present invention may be constructed such that the operation reactive force may be controlled only for one of the lifting operation and lowering operation of a suspened cargo.

A load measuring instrument for detecting the load of a suspended cargo may be adopted as another means for detecting an operating condition of the motor 30. A crane normally includes, as a detecting element for prevention of an overload to prevent lifting of a suspended cargo by an excessive amount or to prevent falling down of the machine or the like, a load measuring instrument for detecting a tensile force applied to a lifting rope on which a suspended cargo is carried. Accordingly, such construction may be employed that, making use of such a known load measuring instrument, a signal from the load measuring instrument may be inputted to the controller 90 to control the operation reactive force.

The operating force controlling device of the present invention can be applied to a construction equipment such as a hydraulic shovel wherein a hydraulic cylinder is employed as an actuator and a working device is operated by the cylinder. The working device may be a bucket, an arm, a boom or the like, and when such working device or devices are operated to carry out a digging operation, control of the operation reactive force similar to that described above may be executed. When, for example, a tip end of a bucket is abutted with some article buried under the ground during such digging operation, the load pressure of a bucket cylinder or the like rises suddenly. Such a sudden change of the load pressure is sensed readily by such operation reactive force control as described hereinabove.

What is claimed is:

1. An operating force controlling device for an operating lever in a hydraulic circuit including a fluid supply source and an actuator comprising:

a valve mechanism having at least two positions for controlling supply of fluid from the fluid supply source to the actuator for placing the actuator in an operating condition;

an operating lever for changing a position of said valve mechanism, said operating lever including a pivotal member;

at least one reactive force mechanism disposed in an opposing relationship to said pivotal member for applying to said operating lever an operation reactive force in a direction opposite to the direction of operation of said lever;

means for detecting an operating condition of said actuator; and a control mechanism connected to said reactive force mechanism, said control mechanism including means for receiving a signal from said detecting means and means for controlling said reactive force mechanism as a function of the received signal such that the reactive force corresponds to the detected operating condition.

2. An operating force controlling device according to claim 1, wherein said actuator is a hydraulic motor connected to a winch drum for lifting and lowering a suspended cargo.

3. An operating force controlling device according to claim 1, wherein said valve mechanism includes a pilot valve on which said operating lever is provided, and a pilot type directional control valve connected between said fluid supply source and said actuator, a secondary side of said pilot valve being connected to a signal receiving portion of said pilot type directional control valve by way of a pilot pipe line.

4. An operating force controlling device according to claim 3, including a pressure detecting means and a pair of pilot pipe lines connected between a pair of secondary side ports of said pilot valve and a pair of signal receiving portions on the opposite ends of said pilot type directional control valve, wherein said pressure detecting means is connected to one of said pilot pipe lines, whereby the direction of operation of said lever and the direction of operation of said actuator are discriminated in accordance with a value detected by said pressure detecting means.

5. An operating force controlling device according to claim 1, further comprising a pair of reactive force mechanisms, wherein said reactive force mechanisms are provided in an opposing relationship on opposite sides of said pivotal member so that said reactive force mechanisms may apply an operation reactive force to said lever in each of two directions of operation.

6. An operating force controlling device according to claim 1, wherein said reactive force mechanism includes a cylinder having a chamber subjected to a fluid pressure for control of the operation reactive force, a piston supported for axial sliding movement in said cylinder, and a rod connected to said piston and disposed in an opposing relationship to said pivotal member.

7. An operating force controlling device according to claim 1, wherein said valve mechanism includes a pilot valve on which said operating lever is provided, and a pilot type directional control valve connected to said fluid supply source and said actuator, a secondary side of said pilot valve being connected to a signal receiving portion of said pilot type directional control valve by way of a pilot pipe line, and said reactive force mechanism includes a cylinder formed integrally with a valve body of said pilot valve and having a chamber subjected to a fluid pressure for control of the operation reactive force, a piston supported for axial sliding movement in said cylinder, and a rod connected to said piston and disposed in an opposing relationship to said pivotal member.

8. An operating force controlling device according to claim 1, wherein said means for detecting an operating condition of said actuator includes a pair of pressure sensors communicating with a pair of ports through which fluid is to be supplied into and discharged from said actuator.

9. An operating force controlling device according to claim 1, wherein said means for controlling said reactive force mechanism includes a controller for outputting, in response to a signal from the detecting means, an electric controlling signal, and a signal outputting means for outputting control fluid to said reactive force mechanism in accordance with the electric controlling signal from said controller.

10. An operating force controlling device according to claim 9, wherein said signal outputting means is an electromagnetic proportional pressure reducing valve for outputting a pilot pressure to said reactive force mechanism in accordance with the electric controlling signal from said controller.

11. An operating force controlling device according to claim 10, including a change-over valve connected to a primary side of said electromagnetic proportional pressure reducing valve and shiftable between a position in which the primary side of said electromagnetic proportional pressure reducing valve is connected to a pilot pressure source and another position in which the primary side is connected to a reservoir.

12. An operating force controlling device according to claim 1, wherein said means for controlling said reactive force mechanism includes controlling means for controlling the rate of change of the reactive force in correspondence with the signal from the detecting means such that the rate of change is high when said actuator is in a light load condition and is low when said actuator is in a heavy load condition.

13. An operating force controlling device according to claim 1, wherein said control mechanism includes a control pattern setting means for setting a plurality of control patterns having different rates of change of the reactive force in correspondence to a signal from the detecting means, and a control pattern selecting means for selecting one of said control patterns.

14. An operating force controlling device according to claim 13, wherein said actuator is a hydraulic motor connected to a winch drum provided for lifting and lowering a suspended cargo, and said control pattern setting means of said control mechanism includes a control pattern for control upon lifting of the suspended cargo and another control pattern for control upon lowering thereof, the rate of change of a reactive force being set higher at the control pattern for control upon lowering than at the control pattern for control upon lifting.

15. An operating force controlling device according to claim 13, wherein at least one of a plurality of control patterns set in said control mechanism is set such that the rate of change of a reactive force controlling signal for control of said actuator in a light load condition is higher than the rate of change of a reactive force controlling signal for control in a heavy load condition.

16. An operating force controlling device according to claim 1, wherein said means for controlling said reactive force mechanism includes an initial value setting means for variably setting an initial value of the reactive force.

17. An operating force controlling device according to claim 1 including means for detecting the direction of operation of said operating lever, mounted on a support member on which said operating lever is supported for pivotal motion.

18. An operating force controlling device according to claim 1, wherein said means for detecting an operating condition of said actuator includes a shuttle valve communicating with a pair of ports supplying and discharging fluid into and from said actuator for selecting the higher pressure at said pair of ports, and a single pressure sensor connected to said shuttle valve for detecting the pressure selected by said shuttle valve.

19. An operating force controlling device according to claim 1, wherein said reactive force mechanism includes a cylinder secured to a support member separate from a valve body of said pilot valve and having a chamber for control of the operation reactive force, a piston supported for axial sliding movement in said cylinder, and a rod connected to said piston and disposed in an opposing relationship to said pivotal member, said piston and said rod being operated by control fluid inputted into said chamber of said cylinder to apply an operation reactive force to said lever, said support member being disposed in a spaced relationship from said valve body of said pilot valve, said lever being operatively connected to an operating portion of said pilot valve via mechanical interlocking means.

* * * * *